US012753954B2

(12) United States Patent
Xu et al.

(10) Patent No.: US 12,753,954 B2
(45) Date of Patent: Oct. 6, 2026

(54) HYBRID DOUBLE-INLET VALVE FOR PULSE TUBE CRYOCOOLER

(71) Applicant: Sumitomo (SHI) Cryogenics of America, Inc., Allentown, PA (US)

(72) Inventors: Mingyao Xu, Allentown, PA (US); Tian Lei, Allentown, PA (US); Ralph C. Longsworth, Mount Desert, ME (US)

(73) Assignee: SUMITOMO (SHI) CRYOGENICS OF AMERICA, INC., Allentown, PA (US)

( * ) Notice: Subject to any disclaimer, the term of this patent is extended or adjusted under 35 U.S.C. 154(b) by 557 days.

(21) Appl. No.: 17/396,938

(22) Filed: Aug. 9, 2021

(65) Prior Publication Data

US 2022/0049878 A1 Feb. 17, 2022

Related U.S. Application Data

(60) Provisional application No. 63/064,528, filed on Aug. 12, 2020.

(51) Int. Cl.
*F25B 9/14* (2006.01)

(52) U.S. Cl.
CPC ..... *F25B 9/145* (2013.01); *F25B 2309/1414* (2013.01); *F25B 2309/1415* (2013.01); *F25B 2309/1418* (2013.01); *F25B 2309/1425* (2013.01)

(58) Field of Classification Search
CPC ..... F25B 9/145; F25B 2309/1414; F25B 2309/1415; F25B 2309/1418; F25B 2309/1425
See application file for complete search history.

(56) References Cited

U.S. PATENT DOCUMENTS 3,205,668 A 9/1965 Gifford
3,237,421 A 3/1966 Gifford
5,595,065 A 1/1997 Boiarski et al.
(Continued)

FOREIGN PATENT DOCUMENTS

CN 101852506 A 10/2010
CN 101943500 A 1/2011
(Continued)

OTHER PUBLICATIONS

International Preliminary Report on Patentability dated Feb. 23, 2023, from the corresponding International Application No. PCT/US2021/045212.
(Continued)

*Primary Examiner* — David J Teitelbaum
(74) *Attorney, Agent, or Firm* — KATTEN MUCHIN ROSENMAN LLP

(57) ABSTRACT

A double-inlet valve for a Gifford-McMahon (GM) type double-inlet pulse tube cryocooler system for providing cooling at cryogenic temperatures includes a fixed restrictor and a needle valve coupled to the fixed restrictor in parallel. The needle valve produces asymmetric flow. The combination of the fixed restrictor and the needle valve having an asymmetric flow provides improved alternating current (AC) flow characteristics and adjustability of direct current (DC) flow to increase the available cooling.

16 Claims, 6 Drawing Sheets

(56) References Cited

U.S. PATENT DOCUMENTS

| | | | | |
|---|---|---|---|---|
| 5,720,172 | A * | 2/1998 | Ishizaki | F16K 17/196 60/517 |
| 5,974,807 | A * | 11/1999 | Gao | F25B 9/145 165/4 |
| 9,157,668 | B2 | 10/2015 | Xu | |
| 10,066,855 | B2 | 9/2018 | Xu et al. | |
| 2007/0176417 | A1* | 8/2007 | Nuccitelli | F16L 27/111 285/227 |
| 2008/0092588 | A1* | 4/2008 | Xu | F25B 9/145 62/600 |
| 2011/0000225 | A1 | 1/2011 | Xu | |
| 2011/0100022 | A1 | 5/2011 | Yuan et al. | |
| 2016/0069593 | A1* | 3/2016 | Tsuchiya | F25B 9/145 62/6 |
| 2020/0003466 | A1 | 1/2020 | Xu et al. | |

FOREIGN PATENT DOCUMENTS

| | | | |
|---|---|---|---|
| CN | 204787457 | U | 11/2015 |
| JP | H04-13058 | A | 1/1992 |
| JP | 09-004936 | A | 1/1997 |
| JP | H11-248278 | A | 9/1999 |
| JP | 2000-230755 | A | 8/2000 |
| JP | 2000-310458 | A | 11/2000 |
| JP | 2003329328 | A | 11/2003 |
| JP | 2005-106297 | A | 4/2005 |
| JP | 3917123 | B2 | 5/2007 |
| JP | 2016-057013 | A | 4/2016 |

OTHER PUBLICATIONS

International Search Report and Written Opinion of the International Searching Authority dated Nov. 26, 2021, from the corresponding International Application No. PCT/US2021/045212.

Office Action dated Apr. 10, 2025, from Korean Patent Application No. 10-2023-7005585, 15 sheets including English translation.

Notice of Reasons for Rejection issued Feb. 6, 2024, from Japanese Patent Application No. 2023-509793, 18 sheets with English translation.

The extended European Search Report dated Aug. 8, 2024, from European Patent Application No. 21856511.7, 6 sheets.

Notification of the First Office Action and Search Report issued Jul. 24, 2025, from Chinese Patent Application No. 202180056723.1, 11 sheets.

* cited by examiner

HYBRID DOUBLE-INLET VALVE FOR PULSE TUBE CRYOCOOLER

CROSS REFERENCE TO RELATED APPLICATIONS

This application claims the priority of U.S. Provisional Application Ser. No. 63/064,528, filed on Aug. 12, 2020, which is hereby incorporated herein by reference in its entirety.

FIELD OF THE INVENTION

This invention relates to an improved double-inlet valve for a Gifford-McMahon (GM) type pulse tube cryocooler that improves performance primarily by a favorable control of direct current (DC) flow.

BACKGROUND

The Gifford-McMahon (GM) type pulse tube refrigerator is a cryocooler, similar to GM refrigerators, which derives cooling from the compression of gas in a compressor connected to an expander by supply and return hoses. The expander cycles gas through inlet and outlet valves using a rotary valve commonly to a cold expansion space through a regenerator. A GM expander creates the cold expansion space by the reciprocation of a solid piston (a piston is often referred to as a displacer when the displaced volume above and below the piston are connected by a regenerator) in a cylinder while a pulse tube expander creates the cold expansion space by the reciprocation of a "gas piston." Pulse tube refrigerators have no moving parts in their cold head, but rather an oscillating gas column within the pulse tube that functions as a compressible piston. The piston includes gas that stays in the pulse tube as it is pressurized and depressurized. The elimination of moving parts in the cold end of the pulse tube refrigerators allows a significant reduction of vibration, as well as greater reliability and lifetime. To reduce the vibration further, the rotary valve is typically connected to the expander by flexible hoses. Two stage GM type pulse tube refrigerators typically use oil lubricated compressors to compress helium and draw 5 to 15 kW, or more, of input power. Major applications today are cooling MM (magnetic resonance imaging) and NMR (nuclear magnetic resonance imaging) magnets, where they cool heat shields at about 40 K and re-condense helium at around 4 K. They are also being used in the early development of quantum computers. These applications require low levels of vibration and low levels of electromagnetic interference (EMI).

GM type pulse tube coolers have been developed in parallel with Stirling type pulse tube coolers which provide the pressure cycle to the regenerator and pulse tube directly from a reciprocating compressor piston. These are widely used in cooling infrared detectors near 70 K in ground and space based systems. They are typically much smaller, and run at much higher speeds e.g. 60 Hz vs. 1 to 2 Hz for GM type pulse tubes. Stirling type pulse tubes are more efficient than GM type pulse tubes because they recover much of the work of expansion but the means of controlling the flow between the warm end of the pulse tube and a buffer volume is different, and they are not as efficient at low temperatures.

W. E. Gifford who was a co-inventor of the GM cycle refrigerator also conceived of an expander that replaced the solid piston with a gas piston and called it a "pulse tube" refrigerator. This was first described in his U.S. Pat. No. 3,237,421 ("the '421 patent") which shows a pulse tube connected to valves like the earlier GM refrigerators. Early development of the pulse tube expander demonstrated that gas entering a vertically oriented tube at the bottom and flowing through a flow smoothing mesh created a stratified column of gas that got hot as it was compressed and pushed towards the top. The top of the tube had a copper cap that absorbed some of the heat so that when the gas flowed out of the tube and cooled as it expanded it cooled the flow smoother and adjacent copper in what is called the cold end. A significant improvement was made to the basic GM type pulse tube by Mikulin et al., as reported in 1984, by adding a buffer volume at the warm end of the pulse tube and flowing gas in and out through a throttle valve. This is now called a basic orifice type pulse tube or a single-inlet valve pulse tube. Subsequent development work has led to the design of several different means of throttling the flow that improve the performance of the pulse tube expander. Most Stirling type pulse tubes are of the single-inlet design.

For GM type pulse tubes it was found that the addition of a second orifice between the warm end of the pulse tube and the inlet to the regenerator improved the performance and made it possible to get below 4 K in a two stage pulse tube. This is now called a double-inlet pulse tube and the second throttling device is called a double-inlet valve. As was the case with the single-inlet valve taking on different forms, the double-inlet valve has taken on different forms. The present invention is a new double-inlet valve that has demonstrated improved performance.

U.S. Pat. No. 3,205,668 ("the '668 patent") by Gifford describes a GM expander that has a solid piston having a stem attached to the warm end which drives the displacer up and down by cycling the pressure above the drive stem out of phase with the pressure cycle to the expansion space. Rotary valves are the most common means of cycling the pressures between high pressure Ph and low pressure Pl. One can think of the flow control at the warm end of a pulse tube as being optimized if the cold boundary of the gas piston follows essentially the same pattern as the cold end of the solid piston. A cycle with the expander described in the '668 patent starts with the displacer held down while the inlet valve opens and increases the pressure to Ph. The piston then moves up and at about ¾ of the way the inlet valve closes and the pressure drops as the piston moves to the top. The outlet valve then opens and the pressure drops to Pl. The piston then moves down and at about ¾ of the way the outlet valve closes and the pressure increases as the piston moves to the bottom. The area of the pressure-volume (P-V) is a measure of the refrigeration produced per cycle. The differences between a solid piston and a gas piston are numerous. They include 1) the length and stroke depend on the pressure ratio and how much gas is allowed to flow in and out of the cold end of the pulse tube, 2) an asymmetry in the valve timing and flow resistances can cause more gas to flow in or out of one end of the pulse tube each cycle than to flow out of or in, referred to as DC flow, and 3) it is very difficult to balance the flow in and out of the cold and warm ends simultaneously to establish a cold boundary, referred to as alternating current (AC) flow, that simulates the movement and the P-V relation of a solid piston. The Stirling cycle pulse tubes with a single-inlet valve avoid the first problem because the compressor piston has a fixed displacement, and it avoids the second problem because the same amount of gas flows out of the buffer volume as flows into it.

While this analogy of a gas piston with a solid piston provides a physical description of the process, it is more common to find the flow patterns described in terms of the phase relationship between the pressure cycle and the mass flow cycle. U.S. Patent application publication No. US 2011/0100022 ("the '022 publication") by Yuan et al. has a good description of phase control devices for Stirling type single-inlet pulse tube cryocoolers. FIG. 2 of the '022 publication shows resistive devices which are described as including an orifice, a short tube, and closely spaced plates. FIG. 2 shows an inertance tube which is a long small diameter tube that acts as an inductance in an electrical analogy. FIG. 8 of the '022 publication shows how these devices can be combined using an electrical circuit analogy to optimize the phase relationship between the pressure cycle and the mass flow cycle that provides the most cooling. FIG. 7 of the '022 publication is a schematic of a single-inlet valve that is comprised of a resistive device in parallel with an inertance device. It is important to note that an inertance device is practical in a Stirling type pulse tube because it is operating at a high frequency. At the low frequencies of GM type pulse tubes only resistive devices are practical. It is also important to note that all of the devices described in the '022 publication have the same flow characteristics with flow in either direction.

Efforts to increase the cooling capacity of two-stage GM type coolers at 4K have included the development of the four-valve design. U.S. Pat. No. 10,066,855 ("the '855 patent") by Xu describes a four-valve pulse tube. This name derives from the phase shifting mechanism comprising a pair of inlet and outlet valves that connect to the warm end of the regenerator and a second pair of inlet and outlet valves that connect to the warm end of the pulse tube. The '855 patent describes flow control mechanisms to balance the flow of gas to second and third stage pulse tubes, each of which requires an additional pair of valves. The four-valve pulse tube does not use a buffer volume and present designs perform slightly better than present designs of double-inlet pulse tubes. They are at a disadvantage that the void volume of the hoses reduces the pressure oscillation and performance however when the valve motor and rotary valve have to be separated from the regenerator. A double-inlet pulse tube only requires one hose between the valve assembly and the pulse tube/regenerator assembly, referred to as the cold end, while the four-valve pulse tube needs one hose to connect to the regenerator and smaller diameter hoses connected to the warm ends of each pulse tube in a multi-stage pulse tube. The improved performance of a double-inlet pulse tube with the present invention makes it possible to get performance that is as good as a four-valve pulse tube in a unit with a remote valve assembly and a single connecting hose. A patent application for an improved connecting hose has recently been filed. This hose reduces the vibration transmitted to the cold head from the valve-motor assembly, and reduces the void volume resulting in improved efficiency.

Japanese (JP) Patent No. 3917123 by Ogura describes the use of a needle valve for the double-inlet valve and a replaceable bushing with a short hole through it for the first inlet valve. The short hole through the bushing has the same flow restriction in either direction for the same flow conditions, and it is a symmetric flow restrictor. The needle valve on the other hand, as it is depicted, has a port at the end that looks at the point of the needle and a port on the side that looks at the stem. As the flow restriction is different for flow at the same conditions in different directions, the flow restriction is asymmetric. The degree of asymmetry depends on a number of factors such as beveling the inlets to the ports, the length of the holes in the ports, etc. Improvements in phase shifting were made possible by simplifying the means of making adjustments.

In addition to optimizing the phase shifting mechanism that controls the P-V relationship in GM type pulse tubes operating near 4 K, it was also found to be important to control the DC flow. U.S. Pat. No. 9,157,668 ("the '668 patent") by Xu describes a double-inlet pulse tube to which a bleed line between a buffer volume and the compressor return line has been added. FIG. 1 of the '668 patent shows the prior art basic double-inlet pulse tube and describes the flow pattern through the double-inlet valves as generating too much DC flow from the warm end to the cold end of the pulse tube. The bleed line from the buffer volume back to the return side of the compressor reduces the DC flow to a rate that optimizes the cooling. This has the disadvantage when the valve assembly is remote from the cold end of requiring an additional connecting line. A two stage double-inlet pulse tube has two tubes in parallel that extend from room temperature to first and second stage temperatures. The warm end of each connects to its own buffer volume and has its own double-inlet valves. The second stage regenerator is an extension of the first stage regenerator so the pressure drop through the first stage regenerator to the cold end of the first stage pulse tube is less than the pressure drop to the cold end of the second stage pulse tube. Optimizing the DC flow in a two stage pulse tube might require having an upward DC flow in the second stage and a downward DC flow in the first stage.

SUMMARY

The present invention is a double-inlet valve that has good AC flow characteristics and provides adjustability of the DC flow to increase the available cooling. It also only requires a single connecting hose between a remote valve assembly and the cold head.

The double-inlet valve comprises a fixed restrictor in parallel with an adjustable needle valve. The flow through the needle valve is asymmetric, that is there is more pressure drop when gas at a given condition enters one port compared to entering the other port. The fixed restrictor can be a short hole having the same symmetric pressure drop for flow in either direction or it can be a tapered hole that has asymmetric flow. This combination provides good AC flow characteristics and adjustability of the DC flow to increase the available cooling. It also only requires a single connecting hose between a remote valve assembly and the cold head.

These advantages and others are achieved by a GM type double-inlet pulse tube cryocooler system for providing cooling at cryogenic temperatures. The GM type double-inlet pulse tube cryocooler system comprises a compressor supplying gas at a supply pressure through a supply line and receiving gas at a return pressure through a return line, a valve assembly connected to the supply and return lines, and a pulse tube cold head connected to the valve assembly. The valve assembly cycles gas between the supply pressure and the return pressure to the pulse tube cold head through a connecting line. The pulse tube cold head comprises at least one regenerator having a warm end and a cold end, at least one pulse tube having a warm end and a cold end, at least one double-inlet valve, a buffer volume connected to the warm end of the pulse tube, a first line extending from the connecting line to the warm end of the regenerator and to the double-inlet valve, a second line connecting the cold end of the regenerator to the cold end of the pulse tube, and a third line from the warm end of the pulse tube to the double-inlet valve and to the buffer volume through a single-inlet valve.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTIONS

Figure 1:
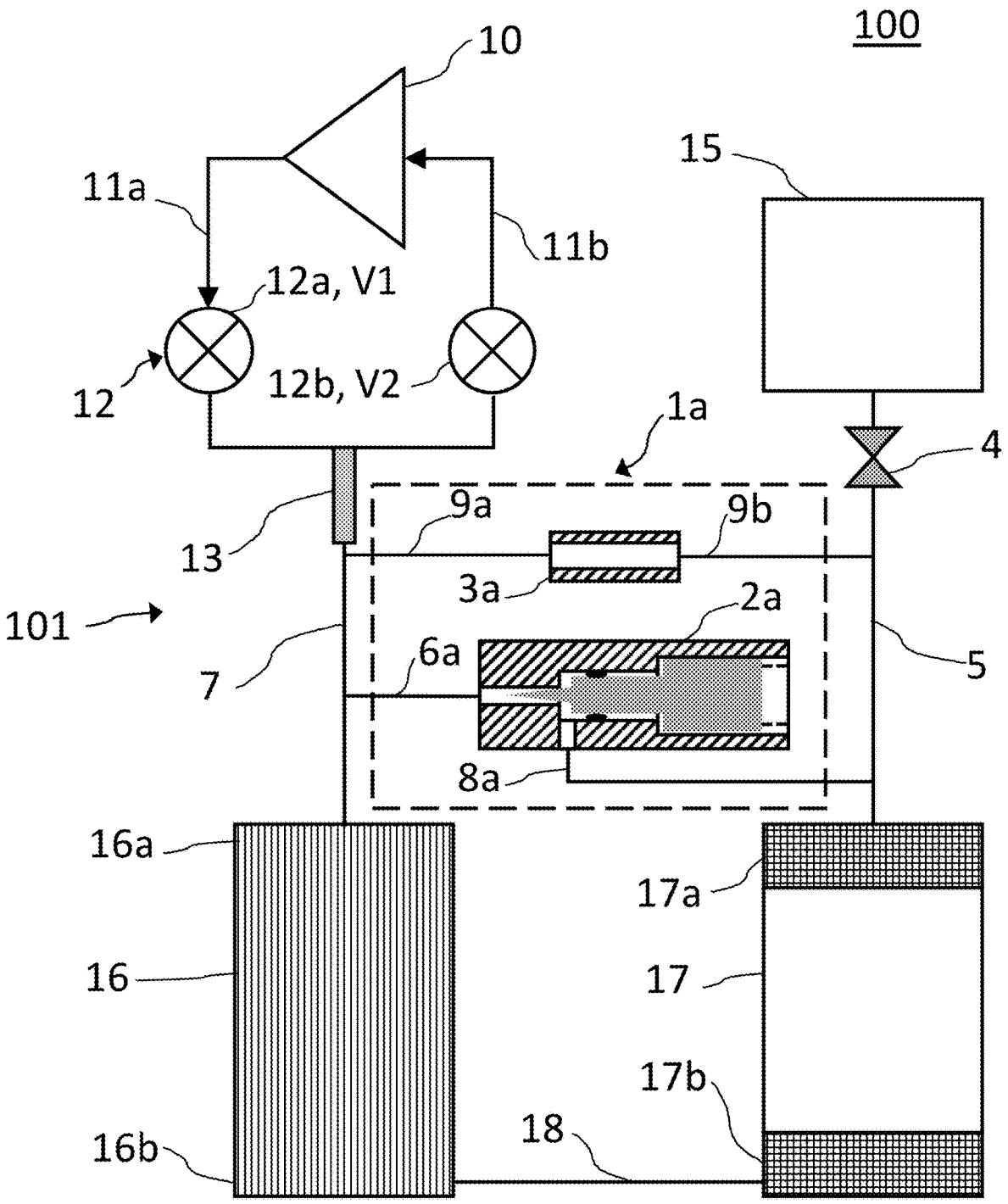
FIG. 1 shows a schematic of a single stage GM type double-inlet pulse tube cryocooler system having a first embodiment of the double-inlet valve of the disclosed invention.

In this section, some embodiments of the invention will be described more fully with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments. Parts that are the same or similar in the drawings have the same numbers and descriptions are usually not repeated.

Figure 5A:
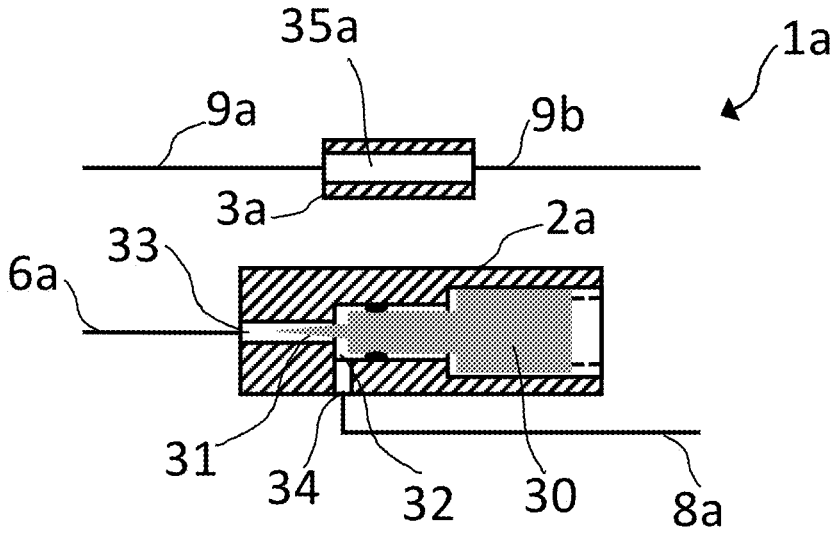
FIGS. 5A-5C show schematics of first, second and third embodiments of the double-inlet valves.

With reference to FIG. 1, shown is a schematic of a single stage GM type double-inlet pulse tube cryocooler system 100 having a first embodiment of the double-inlet valve 1*a* of the disclosed invention. With reference to FIG. 5A, shown is a schematic of the first embodiment of the double-inlet valve 1*a*. Double-inlet valve 1*a* is shown in context of the entire system. Referring to FIGS. 1 and 5A, the single stage GM type double-inlet pulse tube cryocooler system 100 includes a compressor 10, a valve assembly 12 including valves 12*a* and 12*b*, and a pulse tube cold head 101. Compressor 10 is connected to supply valve 12*a*, V1, through supply line 11*a*, and return valve 12*b*, V2, through return line 11*b*. Lines 11*a* and 11*b* are typically flexible metal hoses 5 to 20 meters long, and valves 12*a* and 12*b* are typically slots in a motor driven rotary valve rotating over ports in a stationary seat. Gas, usually helium, cycles in pressure between the supply and return pressures, typically 2.2 MPa and 0.6 MPa, as it flows through connecting line 13 to the warm end 16*a* of the regenerator 16 and the warm end of the pulse tube 17 through the double-inlet valve 1*a*. The compressor 10 supplies gas at a supply pressure through a supply line 11*a* and receives gas at a return pressure through a return line 11*b*. The valves 12*a* and 12*b* are respectively connected to the supply line 11*a* and return line 11*b* that cycles gas between the supply pressure and the return pressure, through a connecting line 13, to a pulse tube cold head 101. Connecting line 13 can be a few millimeters long if valves 12*a* and 12*b* are integral to the pulse tube cold head 101 or it can be up to a meter long if the valves are remote.

The pulse tube cold head 101 includes a regenerator 16 having a warm end 16*a* and a cold end 16*b*, a pulse tube 17 having a warm flow smoother 17*a* at a warm end and a cold flow smoother 17*b* at a cold end, a line 18 connecting the regenerator cold end 16*b* of the regenerator 16 to the cold flow smoother 17*b* of the pulse tube 17, a line 7 extending from the connecting line 13 to the warm end 16*a* of the regenerator 16, lines 6*a* and 9*a* extending from the line 7 to a double-inlet valve 1*a*, a line 5 from the warm flow smoother 17*a* of the pulse tube 17 to a buffer volume 15 through a single-inlet valve 4, and lines 8*a* and 9*b* from the double-inlet valve 1*a* to the line 5 and to the warm flow smoother 17*a* of the pulse tube 17. Cycling flow continues to the warm end 16*a* of regenerator 16 through line 7, and continues to line 5 through double-inlet valve 1*a*. Line 5 connects at one end to the warm end of pulse tube 17 which contains warm flow smoother 17*a*, and at the other end to single-inlet valve 4 which in turn connects to buffer volume 15. The cold end 16*b* of regenerator 16 connects through line 18 to the cold end of pulse tube 17 which contains cold flow smoother 17*b*.

Referring to FIGS. 1 and 5A, double-inlet valve 1*a* includes fixed restrictor 3*a* and needle valve 2*a* which is adjustable for regulating the amount of the flow from both directions. The needle valve 2*a* and the fixed restrictor 3*a* are connected in parallel. The needle valve 2*a* includes a base 30 and a needle 31 extending from the base 30, both of which are disposed inside the cavity 32 formed in the needle valve 2*a*. Needle valve 2*a* includes needle end port 33 that is connected to line 7 through line 6*a*, and stem port 34 that is connected to the line 5 through line 8*a*. The needle 31 protrudes toward the needle end port 33 while the base 30 seals the cavity 32 so that a fluid flow path is formed between the needle end port 33 and stem port 34 through the cavity 32. Moving the needle 31 towards or away from the needle port 33 changes the opening of the flow channel, which changes the flow rates in both directions and the degree of asymmetry between the bidirectional flows. It is noted that the size and shape of the needle 31 and needle port 33 can be varied to change the flow rates in both directions and the degree of asymmetry of needle valve 2*a*, and thus the AC and DC flow characteristics.

The fixed restrictor 3*a* has a hole (flow path) 35*a* that is connected to line 9*a*, which is connected to the line 7, and line 9*b* which is connected to the line 5. The hole 35*a* may have the same cross-sectional area through the length of the hole, and consequently, flow through the restrictor 3*a* is symmetric. The symmetric flow means that gas flow in a direction has the same flow resistance as gas flow in the opposite direction. An asymmetric flow means that gas flow in a direction has a different flow resistances from gas flow in the opposite direction. In the asymmetric flow, flow resistance for gas flowing in a direction is greater or smaller than flow resistance for gas flowing in the opposite direction. The flow through needle valve 2*a* is asymmetric. Flow for gas entering the needle port 33 through line 6*a* is more restricted than flow for gas entering the stem port 34 through line 8*a*. Consequently, gas flow from the needle port 33 to the stem end port 34 has higher flow resistance than the gas flow from the stem port 34 to the needle port 33. In other words, flow in a direction from the needle 31 to the base 30 has a higher flow resistance than an opposite direction.

Figure 2:
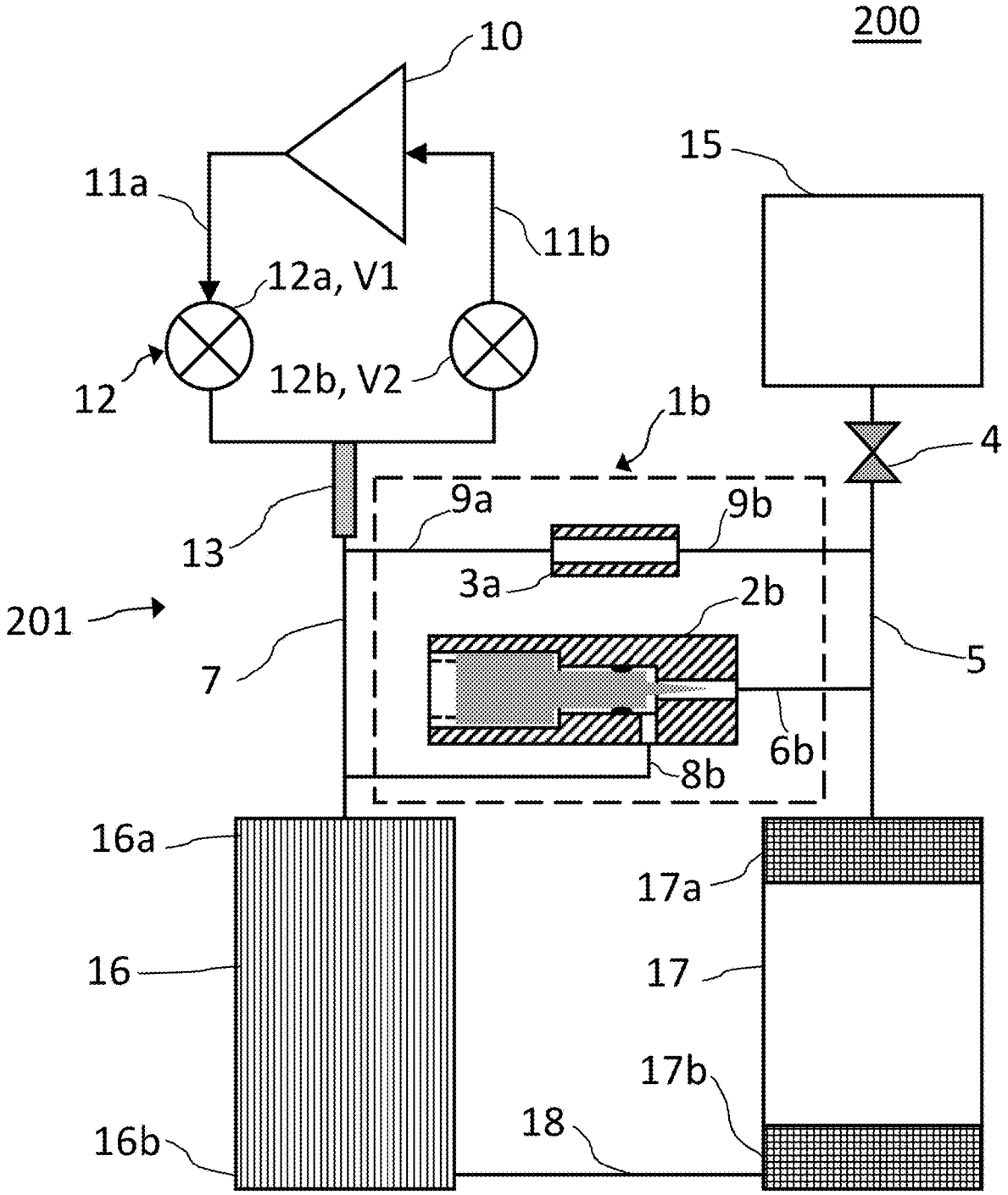
FIG. 2 shows a schematic of a single stage GM type double-inlet pulse tube cryocooler system having a second embodiment of the double-inlet valve of the disclosed invention.
Figure 5B:
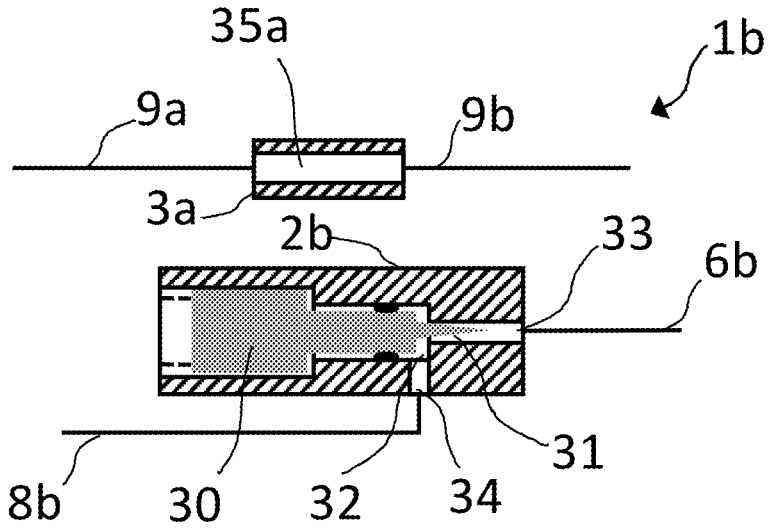

With reference to FIG. 2, shown is a schematic of a single stage GM type double-inlet pulse tube cryocooler system 200, having a second embodiment of the double-inlet valve 1*b* of the disclosed invention. With reference to FIG. 5B, shown is a schematic of the second embodiment of the double-inlet valve 1*b*. Double-inlet valve 1*b* differs from the double-inlet valve 1*a* in having needle valve 2*b* turned around so that the needle end port 33 connects to line 5 through line 6*b* and the stem port 34 connects to line 7 through line 8*b*. The hole 35*a* of the fixed restrictor 3*a* may have the same cross-sectional area through the length of the hole, and consequently, flow through the restrictor 3*a* is symmetric. The flow through needle valve 2*b* is asymmetric. Flow for gas entering the needle port 33 through line 6*b* is more restricted than flow for gas entering the stem port 34 through line 8*b*. Gas flow from the needle port 33 to the stem port 34 has higher flow resistance than the gas flow from the stem port 34 to the needle port 33.

The single stage GM type double-inlet pulse tube cryocooler system 200 includes a compressor 10, a valve assembly 12 including valves 12*a* and 12*b*, and a pulse tube cold head 201. The compressor 10 supplies gas at a supply pressure through a supply line 11*a* and receives gas at a return pressure through a return line 11*b*. The valves 12*a* and 12*b* are respectively connected to the supply line 11*a* and return line 11*b* that cycles gas between the supply pressure and the return pressure, through a connecting line 13, to a pulse tube cold head 201. The pulse tube cold head 201 includes a regenerator 16 having a warm end 16*a* and a cold end 16*b*, a pulse tube 17 having a warm flow smoother 17*a* at a warm end and a cold flow smoother 17*b* at a cold end, a line 18 connecting the regenerator cold end 16*b* to the cold flow smoother 17*b* of the pulse tube 17, a line 7 extending from the connecting line 13 to the warm end 16*a* of the regenerator 16, lines 8*b* and 9*a* extending from the line 7 to a double-inlet valve 1*b*, a line 5 from the warm flow smoother 17*a* of the pulse tube 17 to a buffer volume 15 through a single-inlet valve 4, and lines 6*b* and 9*b* from the double-inlet valve 1*b* to the line 5 and to the warm flow smoother 17*a* of the pulse tube 17.

Figure 3:
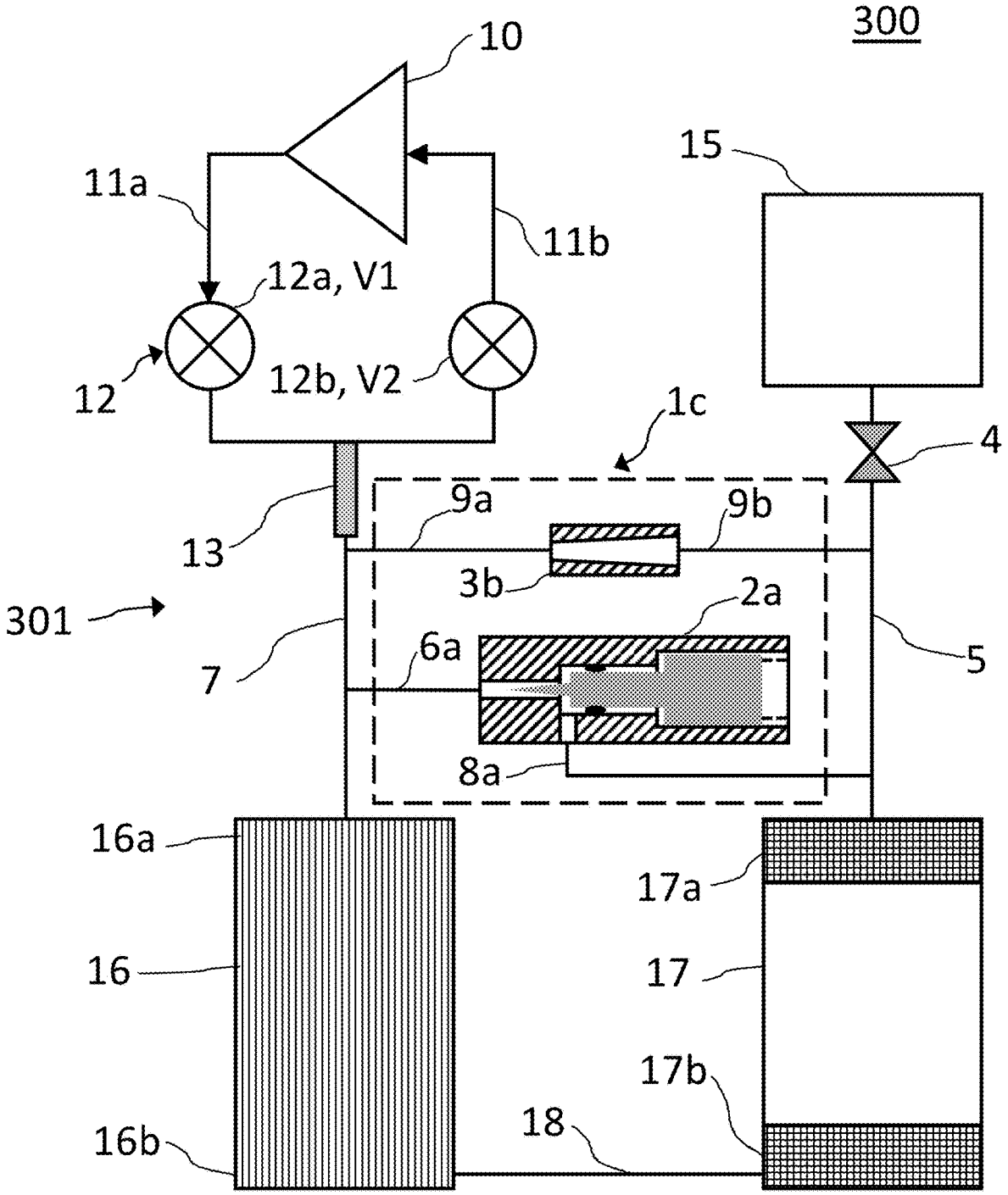
FIG. 3 shows a schematic of a single stage GM type double-inlet pulse tube cryocooler system having a third embodiment of the double-inlet valve of the disclosed invention.
Figure 5C:
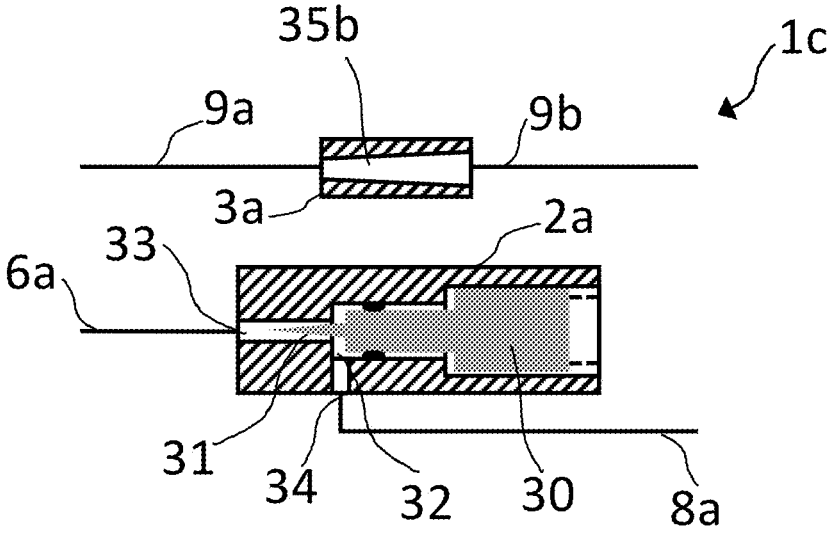

With reference to FIG. 3, shown is a schematic of a single stage GM type double-inlet pulse tube cryocooler system 300, having a third embodiment of the double-inlet valve 1*c* of the disclosed invention. With reference to FIG. 5C, shown is a schematic of the third embodiment of the double-inlet valve 1*c*. Double-inlet valve 1*c* differs from 1*a* in having fixed restrictor 3*b* that has a tapered hole 35*b* which produces an asymmetric flow pattern. In this embodiment, the cross-sectional area of the hole 35*b* increases while proceeding from the connection point of the line 9*a* to the connection point of the line 9*b*. In this configuration, the fixed restrictor 3*b* has lower flow resistance in flow from the line 9*a* to the line 9*b* than flow in the opposite direction. It is understood that asymmetric restrictor 3*b* can be oriented in either direction in combination with adjustable restrictor 2*a* or 2*b*. For example, if the fixed restrictor 3*b* is combined with the needle valve 2*b* of the embodiment shown in FIG. 2, the cross-sectional area of the hole 35*b* may decrease while proceeding from the connection point of the line 9*a* to the connection point of the line 9*b*.

The single stage GM type double-inlet pulse tube cryocooler system 300 includes a compressor 10, a valve assembly 12 including valves 12*a* and 12*b*, and a pulse tube cold head 301. The compressor 10 supplies gas at a supply pressure through a supply line 11*a* and receives gas at a return pressure through a return line 11*b*. The valves 12*a* and 12*b* are respectively connected to the supply line 11*a* and return line 11*b* that cycles gas between the supply pressure and the return pressure, through a connecting line 13, to a pulse tube cold head 301. The pulse tube cold head 301 includes a regenerator 16 having a warm end 16*a* and a cold end 16*b*, a pulse tube 17 having a warm flow smoother 17*a* at a warm end and a cold flow smoother 17*b* at a cold end, a line 18 connecting the regenerator cold end 16*b* to the cold flow smoother 17*b* of the pulse tube 17, a line 7 extending from the connecting line 13 to the warm end 16*a* of the regenerator 16, lines 6*a* and 9*a* extending from the line 7 to a double-inlet valve 1*c*, a line 5 from the warm flow smoother 17*a* of the pulse tube 17 to a buffer volume 15 through a single-inlet valve 4, and lines 8*a* and 9*b* from the double-inlet valve 1*c* to the line 5 and to the warm flow smoother 17*a* of the pulse tube 17.

Figure 4:
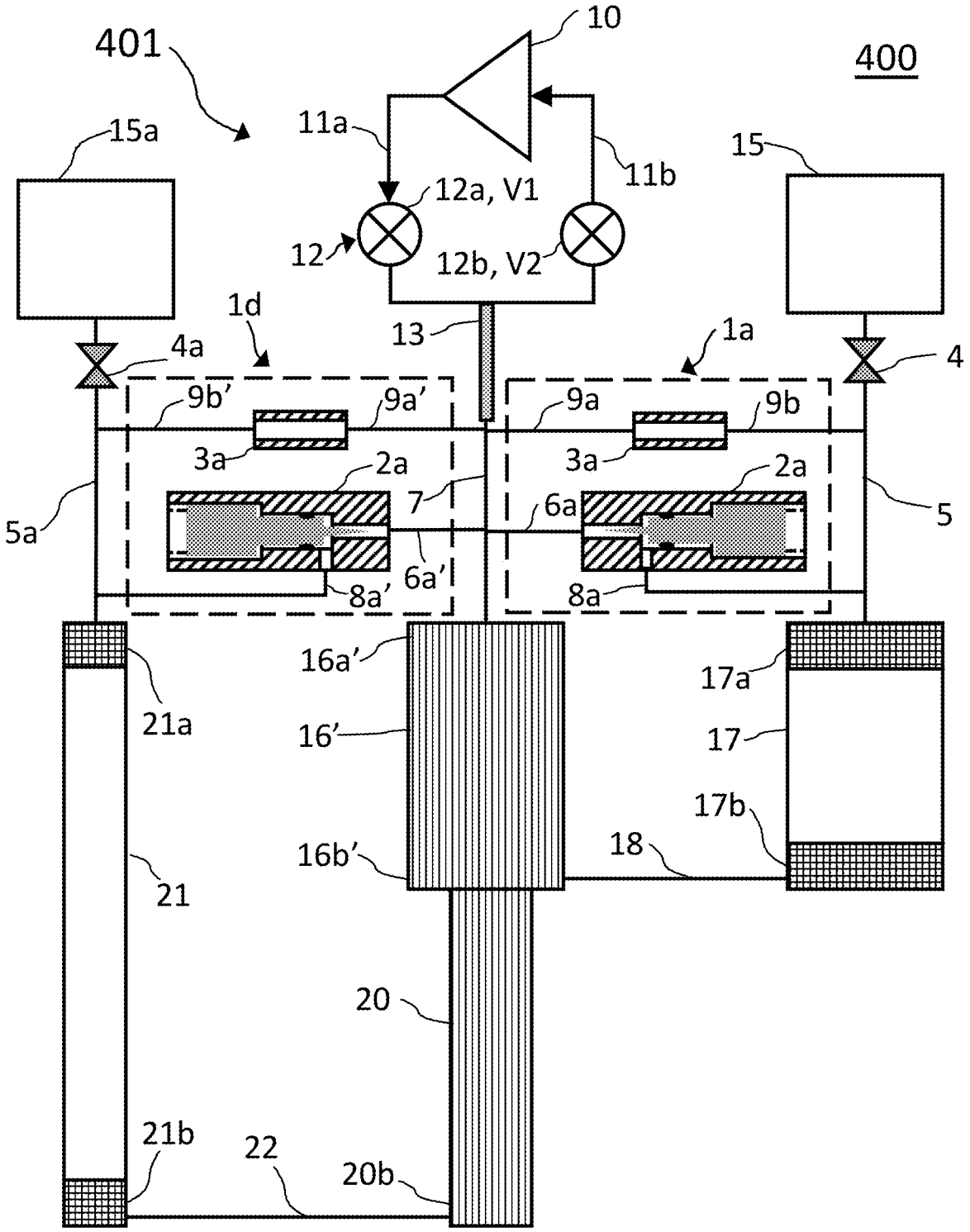
FIG. 4 shows a schematic of a two stage GM type double-inlet pulse tube cryocooler system having an embodiment of the double-inlet valve of the disclosed invention.

With reference to FIG. 4, shown is a schematic of a two stage GM type double-inlet pulse tube cryocooler system 400 which includes two pulse tubes 17 and 21. Double-inlet valve 1*a* is connected to first stage pulse tube system 17 and double-inlet valve 1*d* is connected to second stage pulse tube 21. The double-inlet valve 1*d* is equivalent to 1*a* in structures, but is arranged differently. Specifically, the double-inlet valves 1*a* and 1*d* are arranged in a mirror symmetry with respect to the line 7. Cycling flow continues to the warm end 16*a*' of first stage regenerator 16' and to second stage regenerator 20 through line 7, and continues to line 5 through double-inlet valve 1*a*, and to line 5*a* through second stage double-inlet valve 1*d*. Line 5 connects at one end to the warm end of first stage pulse tube 17 which contains warm flow smoother 17*a*, and at the other end to single-inlet valve 4 which in turn connects to buffer volume 15. Line 5*a* connects at one end to the warm end of the second stage pulse tube 21 which contains warm flow smoother 21*a*, and at the other end to single-inlet valve 4*a* which in turn connects to second stage buffer volume 15*a*.

As shown in FIG. 4, the two stage GM type double-inlet pulse tube cryocooler system 400 includes the second stage regenerator 20 as an extension of first stage regenerator 16'. The second stage pulse tube 21 is separated from first stage pulse tube 17, with the warm end at room temperature. The cold end 16*b*' of first stage regenerator 16 connects through line 18 to the cold end of the first stage pulse tube 17 which contains cold flow smoother 17*b*. The cold end 20*b* of second stage regenerator 20 connects through line 22 to the cold end of the pulse tube 21 which has flow smoother 21*b*. The warm end of first stage pulse tube 17 has flow smoother 17*a* and connects to line 5, which connects to first double-inlet valve 1*a* and buffer volume 15 through single-inlet valve 4. The warm end of second stage pulse tube 21 has flow smoother 21*a* and connects to line 5*a*, which connects to double-inlet valve 1*d* and buffer volume 15*a* through single-inlet valve 4*a*.

The two stage GM type double-inlet pulse tube cryocooler system 400 includes a compressor 10, a valve assembly 12 including valves 12*a* and 12*b*, and a pulse tube cold head 401. The compressor 10 supplies gas at a supply pressure through a supply line 11*a* and receives gas at a return pressure through a return line 11*b*. The valves 12*a* and 12*b* are respectively connected to the supply line 11*a* and return line 11*b* that cycles gas between the supply pressure and the return pressure, through a connecting line 13, to a pulse tube cold head 401. The pulse tube cold head 401 includes first stage regenerator 16' having a warm end 16*a*' and a cold end 16*b*', second stage regenerator 20 attached to the cold end 16*b*' of the first stage regenerator 16' and having a cold end 20*b*, first stage pulse tube 17 having a warm flow smoother 17*a* at a warm end and a cold flow smoother 17*b* at a cold end, second stage pulse tube 21 having a warm flow smoother 21*a* at a warm end and a cold flow smoother 21*b* at a cold end, a line 18 connecting the regenerator cold end 16*b*' to the cold flow smoother 17*b* of the pulse tube 17, a line 22 connecting the regenerator cold end 20*b* to the cold flow smoother 21*b* of the pulse tube 21, a line 7 extending from the connecting line 13 to the warm end 16*a*' of the regenerator 16, lines 6*a* and 9*a* extending from the line 7 to double-inlet valves 1*a*, lines 6*a*' and 9*a*' extending from the line 7 to double-inlet valves 1*d*, a line 5 from the warm flow smoother 17*a* of the pulse tube 17 to a buffer volume 15 through a single-inlet valve 4, and a line 5*a* from the warm flow smoother 21*a* of the pulse tube 21 to a buffer volume 15*a* through a single-inlet valve 4*a*, lines 8*a* and 9*b* from the double-inlet valve 1*a* to the line 5 and to the warm flow smoother 17*a* of the pulse tube 17, and lines 8*a*' and 9*b*' from the double-inlet valve 1*d* to the line 5*a* and to the warm flow smoother 21*a* of the pulse tube 21.

Double-inlet valve 1*a* has been found to give the best results for the present design. For other designs that have different pulse tube and regenerator sizes, double-inlet valves 1*b* and 1*c* may be preferred. Double-inlet valve 1*a* or 1*d* can be solely used on either the first or the second stage of the two stage GM type double-inlet pulse tube cold head 401, combined with a conventional double-inlet valve 2*a* on the other stage.

The terms and descriptions used herein are set forth by way of illustration only and are not meant as limitations. Those skilled in the art will recognize that many variations are possible within the spirit and scope of the invention and the embodiments described herein.

What is claimed is:

1. A double-inlet valve for a Gifford-McMahon (GM) type double-inlet pulse tube cryocooler system for providing cooling at cryogenic temperatures, comprising:

a fixed restrictor having a hole with a constant cross-sectional area or a tapered hole;

a needle valve coupled to the fixed restrictor in parallel, wherein the needle valve comprises a needle end port and a stem port, and wherein the needle valve is configured to allow and adjust flow from both directions between the needle end port and the stem port and to provide a flow resistance in one direction different from a flow resistance in the opposite direction;

a first line directly connecting one end of the fixed restrictor to the needle end port; and a second line directly connecting another end of the fixed restrictor to the stem port.

2. The double-inlet valve of claim 1 wherein a flow through the fixed restrictor is symmetric.

3. The double-inlet valve of claim 1 wherein a flow through the fixed restrictor is asymmetric.

4. The double-inlet valve of claim 1 wherein the needle valve defines a cavity having the needle end port and the stem port, and wherein the needle valve comprises:

a base that seals the cavity; and a needle extending from the base toward the needle end port, wherein a flow in a direction from the needle end port to the stem port has higher flow resistance than a flow in a direction from the stem port to the needle end port.

5. The double-inlet valve of claim 4 wherein the needle valve is adjustable for regulating an amount of the flow between the needle end port and the stem port.

6. A Gifford-McMahon (GM) type double-inlet pulse tube cryocooler system for providing cooling at cryogenic temperatures, comprising;

a compressor supplying gas at a supply pressure through a supply line and receiving gas at a return pressure through a return line;

a valve assembly connected to the supply and return lines; and a pulse tube cold head connected to the valve assembly, wherein the valve assembly cycles gas between the supply pressure and the return pressure to the pulse tube cold head through a connecting line, the pulse tube cold head comprising:

at least one regenerator having a warm end and a cold end;

at least one pulse tube having a warm end and a cold end;

at least one double-inlet valve comprising:

a fixed restrictor having a hole with a constant cross-sectional area or a tapered hole; and a needle valve coupled to the fixed restrictor in parallel, wherein the needle valve comprises a needle end port and a stem port, and wherein the needle valve is configured to allow and adjust flow from both directions between the needle end port and the stem port and to provide a flow resistance in one direction different from a flow resistance in the opposite direction;

a buffer volume connected to the warm end of the pulse tube;

a first line extending from the connecting line to the warm end of the regenerator, wherein one end of the fixed restrictor and one of the needle end port and the stem port are connected to the first line;

a second line connecting the cold end of the regenerator to the cold end of the pulse tube; and a third line extending from the warm end of the pulse tube to the buffer volume through a single-inlet valve, wherein another end of the fixed restrictor and the other of the needle end port and the stem port are both connected to the third line at positions between the warm end of the pulse tube and the single-inlet valve.

7. The GM type double-inlet pulse tube cryocooler system of claim 6 wherein a flow through the fixed restrictor is symmetric.

8. The GM type double-inlet pulse tube cryocooler system of claim 6 wherein a flow through the fixed restrictor is asymmetric.

9. The GM type double-inlet pulse tube cryocooler system of claim 6 wherein the needle valve defines a cavity having the needle end port and the stem port, and wherein the needle valve comprises:

a base that seals the cavity; and a needle extending from the base toward the needle end port, wherein a flow in a direction from the needle end port to the stem port has higher flow resistance than a flow in a direction from the stem port to the needle end port.

10. The GM type double-inlet pulse tube cryocooler system of claim 9 wherein the needle valve is adjustable for regulating an amount of the flow between the needle end port and the stem port.

11. The GM type double-inlet pulse tube cryocooler system of claim 9 wherein the needle end port is connected to the first line and the stem port is connected to the third line.

12. The GM type double-inlet pulse tube cryocooler system of claim 11 wherein the fixed restrictor has lower flow resistance in a flow from the first line to the third line than in a flow from the third line to the first line.

13. The GM type double-inlet pulse tube cryocooler system of claim 9 wherein the needle end port is connected to the third line and the stem port is connected to the first line.

14. The GM type double-inlet pulse tube cryocooler system of claim 6 wherein the pulse tube cold head further comprises:

a second stage regenerator connected to the cold end of the regenerator;

a second stage pulse tube having a warm end and a cold end;

a second stage double-inlet valve connected to the first line;

a second stage buffer volume connected to the warm end of the second stage pulse tube;

a fourth line connecting the cold end of the second stage pulse tube to a cold end of the second stage regenerator; and a fifth line from the warm end of the second stage pulse tube to the second stage double-inlet valve and to the second stage buffer volume through a single-inlet valve.

15. The GM type double-inlet pulse tube cryocooler system of claim 6 wherein the connecting line between the valve assembly and the pulse tube cold head is a single flexible hose.

16. The GM type double-inlet pulse tube cryocooler system of claim 6 wherein the connecting line between the valve assembly and the pulse tube cold head is at least 0.5 meter long.

* * * * *